US005884469A

United States Patent [19]

Mann et al.

[11] Patent Number: 5,884,469

[45] Date of Patent: Mar. 23, 1999

[54] RING-SPINNING MACHINE WITH TRAVELING UNDERWIND-RESIDUE REMOVER

[75] Inventors: Peter Mann, Süssen; Jakob Bothner, Göppingen, both of Germany

[73] Assignee: Zinser Textilmaschinen GmbH, Ebersbach/Fils, Germany

[21] Appl. No.: 886,273

[22] Filed: Jul. 1, 1997

[30] Foreign Application Priority Data

Jul. 4, 1996 [DE] Germany ..... 196 27 014.6

[51] Int. Cl.[6] ..... D01H 9/00

[52] U.S. Cl. ..... 57/306; 57/303

[58] Field of Search ..... 57/303, 306, 268, 57/269, 299; 28/226

[56] References Cited

U.S. PATENT DOCUMENTS

| | | | |
|---|---|---|---|
| 3,263,407 | 8/1966 | Jones | 57/306 |
| 3,312,051 | 4/1967 | Schumann et al. | 57/306 |
| 5,311,732 | 5/1994 | Friedrich | 57/306 |
| 5,479,770 | 1/1996 | Bothner et al. | 57/303 |
| 5,579,630 | 12/1996 | Inverardi | 57/303 |

FOREIGN PATENT DOCUMENTS

| | | | |
|---|---|---|---|
| 41 40 049 | 6/1993 | Germany . | |
| 42 31 737 | 3/1994 | Germany . | |
| 60-11128 | 3/1985 | Japan | 57/303 |

*Primary Examiner*—William Stryjewski
*Attorney, Agent, or Firm*—Herbert Dubno

[57] ABSTRACT

Along a row of spindles of a ring-spinning machine, an underwind-residue remover is displaceable by a belt whose belt stretches are horizontal and lie one above the other over the length of the machine. The underwined-residue remover has a shank guided along a rib at a track for the remover alongside a row of spindles and the track has a foot extending horizontally from the rib and overlain by the stretches of the belt. The stretches of the belt have loops connecting them at opposite ends and a roller arrangement about which the respective loop passes.

16 Claims, 3 Drawing Sheets

RING-SPINNING MACHINE WITH TRAVELING UNDERWIND-RESIDUE REMOVER

FIELD OF THE INVENTION

Our present invention relates to a ring-spinning machine with a multiplicity of spindles arrayed in at least one row with each spindle forming a respective work station, and at least one underwind-residue remover displaceable along at least one spindle row and provided with a tractive element which draws the underwind-residue remover along the row of spindles.

BACKGROUND OF THE INVENTION

Underwind-residue removers can be provided in a ring-spinning machine, for example, for removing the yarn or thread residue in the underwind region below the bobbin-receiving portion of the spindles of such machines.

In DE 41 40 049, for example, a spinning machine with a traveling cleaner and underwind-residue remover is known in which with the aid of a single wire or cable a connection is made between the traveling cleaner disposed ahead of the spindle row and the movable underwind-residue remover behind the spindle row.

DE 42 31 737 describes a system in which the underwind-residue remover is displaceable in a guide rail or track which can lie behind the spindle row and whereby the underwind-residue remover is connectable with a traveling cleaner by a synchronizing drive system. In all cases, the tractive element which was used to displace the underwind-residue removal had to pass through the creel and had to be matched to the different configurations of the creels which were used. The tractive element generally was disposed in the open since the housing of the tractive element was very expensive and difficult to achieve. There thus was a considerable risk of injury to operating personnel. For guiding the tractive element, space had to be provided which could not be occupied by other machine parts and frequently, therefore, this complicated the construction of the machine.

OBJECTS OF THE INVENTION

It is the principal object of the present invention to provide a simpler drive system for a traveling underwind-residue remover whereby the earlier drawbacks can be obviated.

It is a more specific object of the invention to provide an improved underwind-residue removal system which can be of simplified construction, which can occupy less space than has hitherto been required and which can reduce the danger of injury.

SUMMARY OF THE INVENTION

These objects and others which will become apparent hereinafter are attained, in accordance with the invention by providing the tractive element as a traction belt and disposing both of the stretches or passes of the belt so that they lie horizontally and are superposed, one above the other as the traction belt extends through the ring-spinning machine. The horizontal arrangement of the stretches provides a significant space saving by comparison with conventional systems and does not require the provision of a housing since a horizontally moving belt is not likely to cause injury even if it should be contacted by operating personnel.

In a ring-spinning machine in which the underwind residue remover has a support guided along an upstanding rib or shank of the guide track or rail, the two stretches can be disposed one above the other and a horizontal foot of the track or rail. Here again a space saving is achieved.

The traction belt can be composed of a material with a minimum residual elongation, for example, a rubber belt with steel wire or fabric reinforcement, and the belt can be provided with surface profiling or contouring. The surface profiling or contouring can be that of a waffle pattern. The surface contouring precludes significant increase in friction between the counter-moving surfaces of the two stretches, e.g. as a result of inclusion between them of a viscous medium, as may occur in the case of excess lubrication.

The two stretches of the belt can be connected by loops at opposite ends thereof, the loops being engaged in roller arrangements at these ends. At least one of the roller arrangements can be provided with a drive roller and advantageously, the loop at each end can pass around at least one roller at the respective end of the belt. Each roller arrangement can include at least one further roller engaging an outer surface of the belt and, in an embodiment of the invention, two rollers can engage outer surfaces of the two stretches.

More particularly the ring-spinning machine can have an underwind removal assembly which comprises:

- a traveling underwind-residue remover displaceable along the row for successive juxtaposition with the underwind regions of the spindles for removing thread residues therefrom;
- guide means forming a track for guiding the underwind-residue remover alongside the row of spindles; and
- means including a traction belt having two stretches extending along the guide means, the underwind-residue remover being connected to the tractive element, the traction belt element having an upper horizontal belt stretch overlying a lower horizontal belt stretch, and means for displacing the traction belt to shift the underwind-residue remover along the row.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
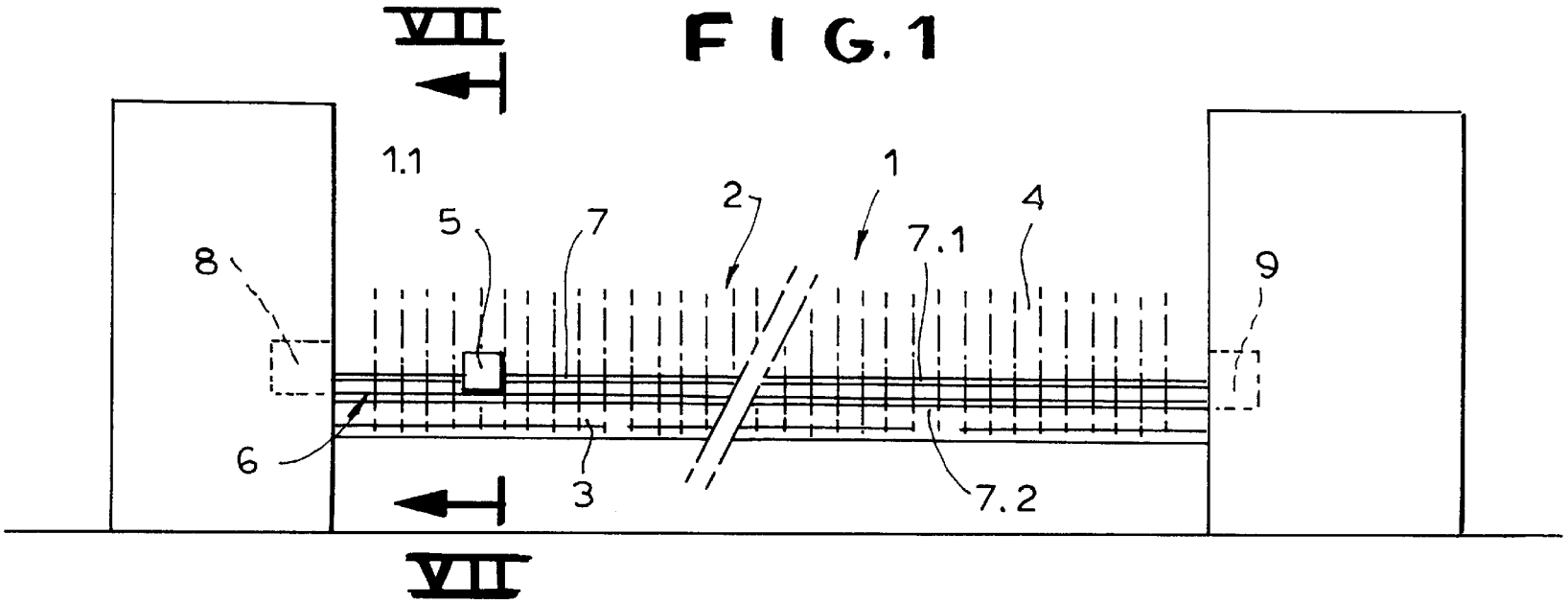
FIG. 1 is a schematic front elevational view of a ring-spinning machine having a traveling underwind-residue remover according to the invention.

FIG. 1 shows, in a front view and in highly diagrammatic form the elements of a ring-spinning machine important to the invention. The machine as a whole is represented at 1 and comprises a multiplicity of work stations spaced along the length of the machine in a machine stand 1.1. Each of the stations 2 comprises a spindle 4 journaled on a spindle rail 3 and driven by usual whorls and a belt drive for the whorls or individual drives for each spindle in a manner known per se. The ring rail and traveler rings, the means for holding the roving bobbins for spinning of the roving onto bobbins on the spindles 4 and the usual doffing and related apparatus have not been illustrated.

Along the row of spindles 4 an underwind-residue remover 5 is movable and is affixed, for this purpose to a traction system represented generally at 6 and comprising a traction belt 7 formed with an upper stretch 7.1 and a lower stretch 7.2. The underwind-residue remover 5 which can be of the type described in the aforementioned patent documents, is affixed to the belt 7.

Figure 8:
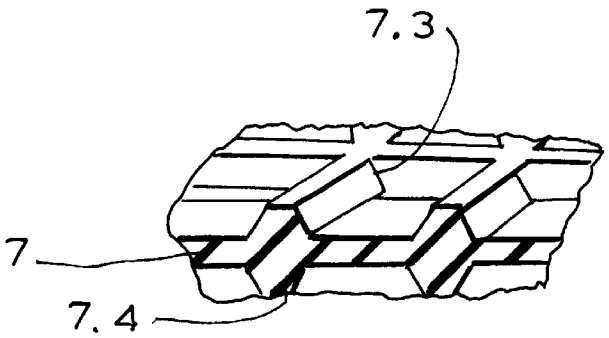
FIG. 8 is a perspective sectional view showing one example of the belt surfaces, e.g. waffle patterns.

According to the invention, the two stretches 7.1 and 7.2 are horizontal, i.e. the belt stretches lie in horizontal planes, and extend in superposed relationship along the entire length of the spindle rail of the ring-spinning machine 1. The traction belt 7 is composed of a material having a low residual stretch, e.g. steel cable reinforced rubber with the reinforcement extending longitudinally. The surfaces of the belt are profiled, e.g. with waffle patterns 7.3 and 7.4 as shown, for example, in FIG. 8.

At both ends of the belt 7 and hence of the stretches 7.1 and 7.2, the stretches 7.1 and 7.2 are connected by loops which are engaged by roller arrangements, one of which shown at 8 can include a drive for the belt while the other, shown at 9, can simply be a deflecting roller arrangement about which the belt is looped.

Figure 5:
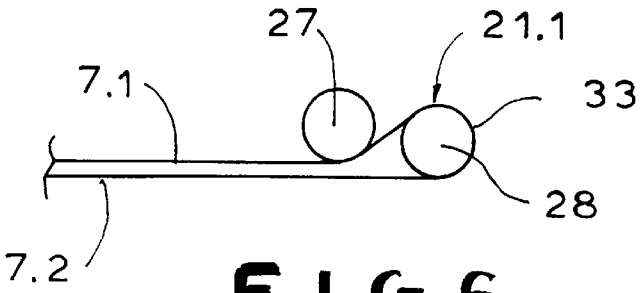
FIG. 5 is a view showing a possible roller arrangement for the embodiment of FIG. 2.
Figure 6:
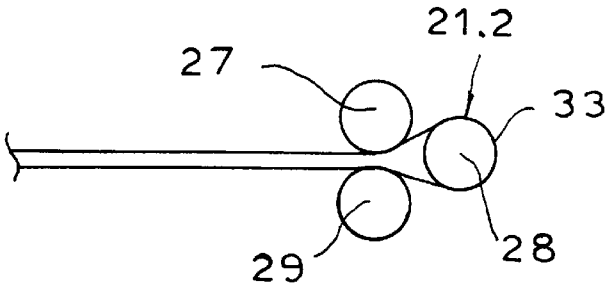
FIG. 6 is a view similar to FIG. 5 corresponding to the opposite end of the belt of FIG. 3 or FIG. 4.
Figure 2:
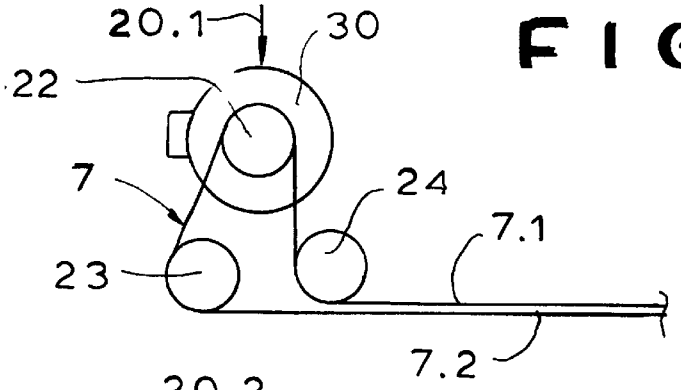
FIG. 2 is a detail view of a roller arrangement at one end of the traction belt showing the drive motor and a pair of additional rollers.
Figure 3:
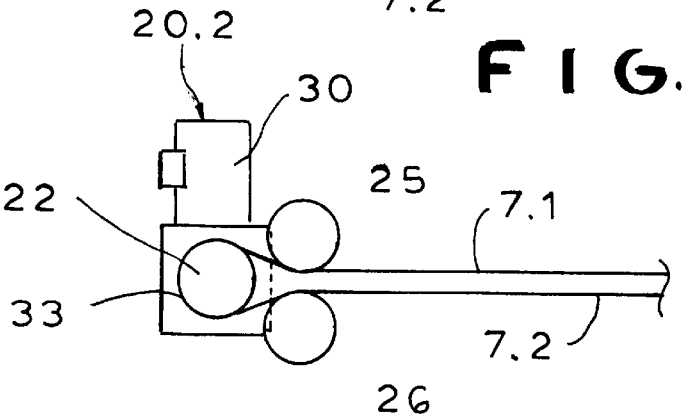
FIG. 3 is a view similar to FIG. 2 but showing an embodiment wherein one roller is located within the loop and a pair of rollers engage outer surfaces of the two stretches.
Figure 4:
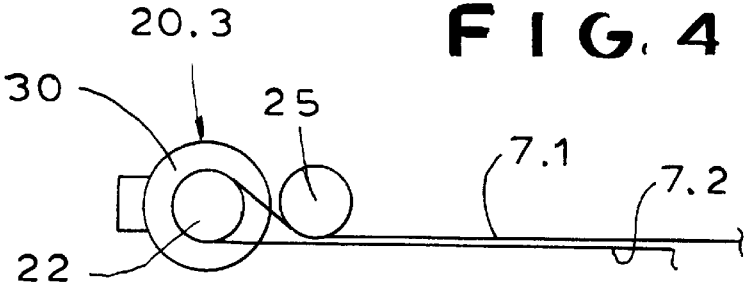
FIG. 4 is a view similar to FIG. 2 of a less complex arrangement than that of FIG. 3.

FIGS. 2–4 show the drive arrangements while FIGS. 5 and 6 show the loop arrangements, respectively. In FIG. 2, for example, the belt is looped around a drive roller 22 of a motor 30 of the roller arrangement 20' and the stretches end at idler rollers 23 and 24, respectively.

In the drive arrangement of FIG. 3, the roller assembly 20.2 can comprise a motor 30 having a transmission which propels the drive roller 22 about which the belt loop 33 passes. A pair of pressing rollers 25, 26 engage the outer surfaces of the stretches 7.1 and 7.2 between which the belt is displaceable.

In the embodiment of FIG. 4, the roller arrangement 20.3 has a motor 30 substantially horizontally aligned with the belt, with a drive roller 22 about which the belt is looped, and a single pressing roller 25 engaging the outer surface of the belt.

In all of these embodiments, operation of the roller frictionally entrains the belt.

The drive roller 22 in each case is located within the belt loop.

FIGS. 5 and 6 show roller arrangements 21.1 and 21.2 in which a loop of the belt passes around an inner roller 28 and the belt itself is externally engaged by one roller 27 (FIG. 5) or two rollers 27 and 29 (FIG. 6) positioning the stretches 7.1 and 7.2

Figure 7:
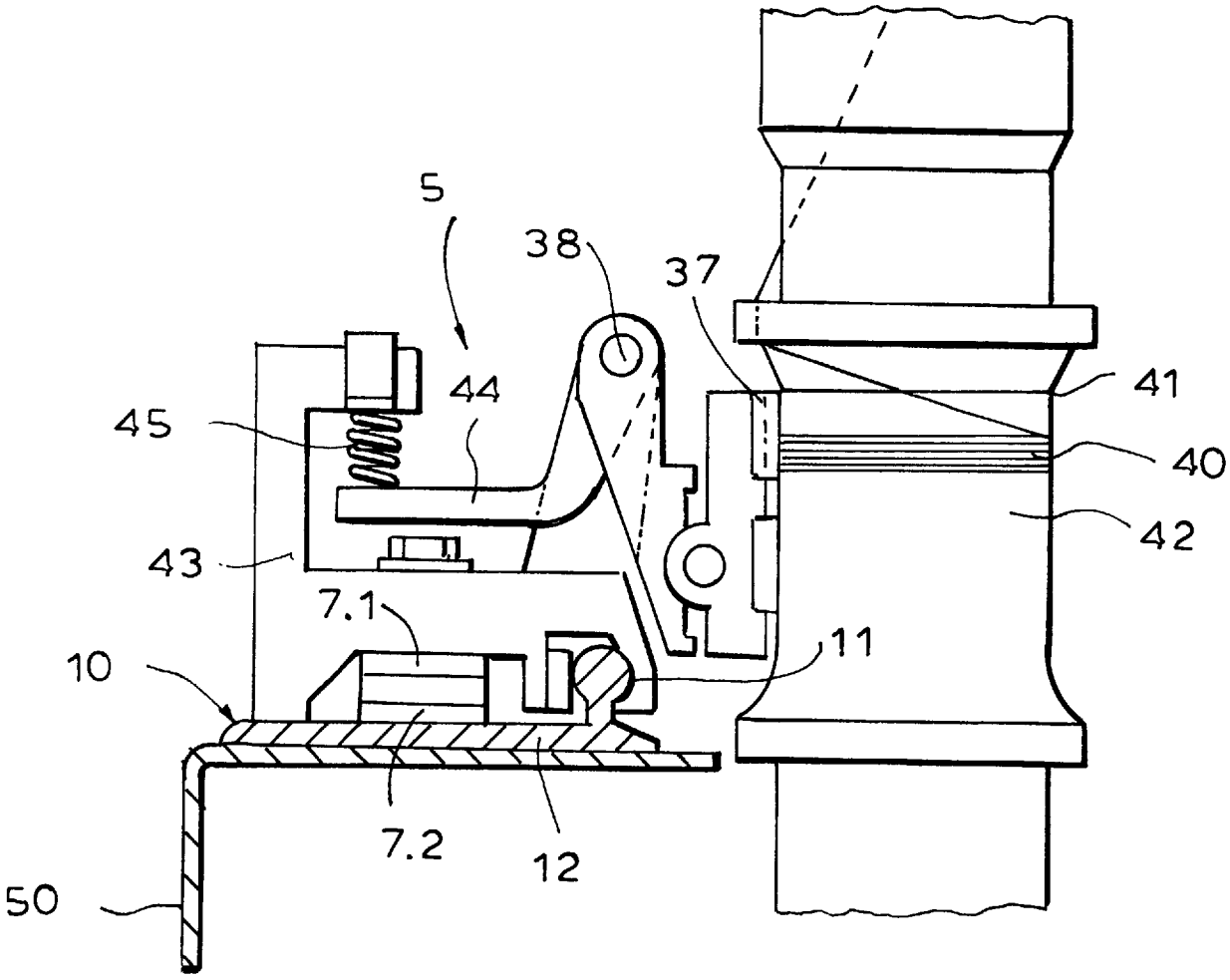
FIG. 7 is a section generally along the line VII—VII of FIG. 1.

FIG. 7 is a section along line VII—VII of FIG. 1 and shows that the track for the underwind-residue remover 5 is a rail 10 with a shank or rib 11 and a foot 12. The rib or shank 11 serves as a guide for the support 43 of the underwind-residue remover 5.

The underwind-residue remover 5 comprises a double arm lever 44 biased by a spring 45 about a fulcrum pin 38 and having a tool portion 37 which can rub against the underwind portion of the spindle to remove the residue therefrom. The underwind residue is shown at 40 wound around the underwind region 42 of the spindle which can be profiled, e.g. knurled at 41 to facilitate gripping of a thread.

The two stretches 7.1 and 7.2 of the traction belt 7 are disposed along the foot 12, one above the other and, while a gap has been shown between the stretches 7.1 and 7.2 for clarity of illustration, it will be understood in practice that practically no gap is present and that the surfaces of the two stretches may be in contact with one another. The arrangement shown is safe and compact and can be used even without the provision of a housing for protecting the belt stretches against contact by an operator.

We claim:

1. In a ring spinning machine having at least one row of spindles, each having an underwind region upon which thread residue collects, the improvement which comprises:

a traveling underwind-residue remover displaceable along said row for successive juxtaposition with said underwind regions of said spindles for removing thread residues therefrom;

guide means forming a track for guiding said underwind-residue remover alongside said row of spindles; and means for driving said traveling underwind-residue remover including a traction belt having two stretches extending along said guide means, said underwind-residue remover being connected an upper horizontal belt stretch of to said traction belt, wherein said upper horizontal belt stretch overlies a lower horizontal belt stretch of said traction belt, and means for displacing said traction belt to shift said underwind-residue remover along said row.

2. The improvement defined in claim 1 wherein said belt is composed of a material with minimum residual stretch.

3. The improvement defined in claim 1 wherein the two stretches of the belt have loops connecting them at opposite ends and at least one roller arrangement about which the respective loop passes.

4. The improvement defined in claim 3 wherein at least one of the roller arrangements has a drive roll entraining said belt.

5. The improvement defined in claim 3 wherein each of said roller arrangements comprises two rollers, one of said rollers of each arrangement being received in the respective loop and the other roller of the respective arrangement engaging one of said stretches of the belt from the exterior.

6. The improvement defined in claim 5 wherein each roller arrangement includes a pair of rollers engaging external surfaces of the belt.

7. In a ring spinning machine having at least one row of spindles, each having an underwind region upon which thread residue collects, the improvement which comprises:

a traveling underwind-residue remover displaceable along said row for successive juxtaposition with said underwind regions of said spindles for removing thread residues therefrom;

guide means forming a track for guiding said underwind-residue remover alongside said row of spindles; and means for driving said traveling underwind-residue remover including a traction belt having two stretches extending along said guide means, said underwind-residue remover being connected to said traction belt, said traction belt having an upper horizontal belt stretch overlying a lower horizontal belt stretch, and means for displacing said traction belt to shift said underwind-residue remover along said row, said underwind-residue remover has a shank guided along a rib of said track, said track having a foot extending horizontally from said rib and said stretches of said belt overlying said foot.

8. The improvement defined in claim 7 wherein the two stretches of the belt have loops connecting them at opposite ends and at least one roller arrangement about which the respective loop passes.

9. The improvement defined in claim 8 wherein at least one of the roller arrangements has a drive roll entraining said belt.

10. The improvement defined in claim 8 wherein each of said roller arrangements comprises two rollers, one of said rollers of each arrangement being received in the respective loop and the other roller of the respective arrangement engaging one of said stretches of the belt from the exterior.

11. The improvement defined in claim 10 wherein each roller arrangement includes a pair of rollers engaging external surfaces of the belt.

12. In a ring spinning machine having at least one row of spindles, each having an underwind region upon which thread residue collects, the improvement which comprises:

a traveling underwind-residue remover displaceable along said row for successive juxtaposition with said underwind regions of said spindles for removing thread residues therefrom;

guide means forming a track for guiding said underwind-residue remover alongside said row of spindles; and means for driving said traveling underwind-residue remover including a traction belt having two stretches extending along said guide means, said underwind-residue remover being connected to said traction belt, said traction belt having an upper horizontal belt stretch overlying a lower horizontal belt stretch, and means for displacing said traction belt to shift said underwind-residue remover along said row, said belt is provided with surface profiling in a waffle pattern.

13. The improvement defined in claim 12 wherein the two stretches of the belt have loops connecting them at opposite ends and at least one roller arrangement about which the respective loop passes.

14. The improvement defined in claim 13 wherein at least one of the roller arrangements has a drive roll entraining said belt.

15. The improvement defined in claim 13 wherein each of said roller arrangements comprises two rollers, one of said rollers of each arrangement being received in the respective loop and the other roller of the respective arrangement engaging one of said stretches of the belt from the exterior.

16. The improvement defined in claim 15 wherein each roller arrangement includes a pair of rollers engaging external surfaces of the belt.

* * * * *